US007621618B2

(12) United States Patent
Suzuki et al.

(10) Patent No.: US 7,621,618 B2
(45) Date of Patent: Nov. 24, 2009

(54) LIQUID DISCHARGE DEVICE

(75) Inventors: Ryohei Suzuki, Nagoya (JP); Masaru Takeuchi, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 561 days.

(21) Appl. No.: 11/554,780

(22) Filed: Oct. 31, 2006

(65) Prior Publication Data

US 2007/0119983 A1 May 31, 2007

(30) Foreign Application Priority Data

Oct. 31, 2005 (JP) ..... 2005-317051

(51) Int. Cl.
*B41J 2/165* (2006.01)

(52) U.S. Cl. ..... 347/29; 347/23; 347/30

(58) Field of Classification Search ..... 347/20, 347/23, 24, 29–33, 43
See application file for complete search history.

(56) References Cited

FOREIGN PATENT DOCUMENTS

JP H06-126947 A 5/1994
JP H08-099416 A 4/1996
JP 2002-361905 * 12/2002
JP 2004074661 A 3/2004

* cited by examiner

*Primary Examiner*—Shin-Wen Hsieh
(74) *Attorney, Agent, or Firm*—Baker Botts L.L.P.

(57) ABSTRACT

A liquid discharge device is provided with a head, a cover member, a negative pressure source, a seal member, and a controller. The head has a nozzle plane in which a nozzle is formed. The cover member has a fluid passage and is capable of covering the nozzle plane such that one end of the fluid passage is in communication with the nozzle. The negative pressure source is connected to the fluid passage. The seal member has a non-nozzle plane in which the nozzle is not formed. The non-nozzle plane is capable of sealing the one end of the fluid passage. The controller drives the negative pressure source in a first state in which the cover member is covering the nozzle plane. The controller drives the negative pressure source in a second state in which the non-nozzle plane is sealing the one end of the fluid passage.

16 Claims, 12 Drawing Sheets

LIQUID DISCHARGE DEVICE

CROSS-REFERENCE TO RELATED APPLICATION

This application claims priority to Japanese Patent Application No. 2005-317051, filed on Oct. 31, 2005, the contents of which are hereby incorporated by reference into the present application.

BACKGROUND OF THE INVENTION

1. Field of the Invention

The present invention relates to a liquid discharge device having a head for discharging liquid from a nozzle.

2. Description of the Related Art

Liquid discharge devices having a head for discharging liquid such as ink or the like from a nozzle are widely known. For example, ink jet printers are an example of a liquid discharge device. For example, some ink jet printers include a cap that covers a nozzle plane of the head, and a negative pressure source connected to the cap. The negative pressure source is driven while the cap is covering the nozzle plane. Old ink present in the nozzle is thus sucked out.

When the ink in the nozzle is sucked out, this ink adheres to the cap. The following technique has been proposed to remove the ink adhering to the cap. That is, the following is taught in Japanese Patent Application Publication No. 6-126947: after the ink of the nozzle has been sucked out, the negative pressure source is driven while a space is formed between the cap and the nozzle plane of the head. Below, supplying negative pressure to the cap after the ink of the nozzle has been sucked out is termed vacuum sucking.

In the aforementioned technique, the vacuum sucking is performed while the cap is facing the nozzle. The space between the nozzle plane and the cap is small. In this case, there is the possibility that ink is sucked from the nozzle when the vacuum sucking is performed. When ink is sucked from the nozzle, this ink adheres to the cap. In this technique, there is the possibility that the vacuum sucking causes the ink to adhere to the cap.

If the space between the nozzle plane and the cap is increased, the ink would probably not be sucked from the nozzle. In this case, however, a large negative pressure cannot be applied to the ink adhering to the cap, and the ink cannot be efficiently removed from the cap.

BRIEF SUMMARY OF THE INVENTION

The technique taught in the present specification aims to efficiently remove liquid adhering to a member (a cap in the above example) that covers a nozzle plane of a head. One technique taught in the present specification is a liquid discharge device.

This liquid discharge device is provided with a head, a cover member, a negative pressure source, a seal member, and a controller. The head has a nozzle plane in which a nozzle is formed. The cover member has a fluid passage. The cover member is capable of covering the nozzle plane such that one end of the fluid passage is in communication with the nozzle. The negative pressure source is connected to the fluid passage. The controller is capable of driving the negative pressure source in a first state in which the cover member is covering the nozzle plane. In this state, liquid, etc. is removed from the nozzle. This liquid passes along the fluid passage of the cover member. This liquid may adhere to the fluid passage.

The seal member has a non-nozzle plane in which the nozzle is not formed. The non-nozzle plane is capable of sealing the one end of the fluid passage. The controller is capable of driving the negative pressure source in a second state in which the non-nozzle plane is sealing the one end of the fluid passage. Vacuum sucking is performed in the state where the one end of the fluid passage is being sealed (this may be a complete seal or a partial seal). In this case, the fluid passage is not facing the nozzle, and consequently liquid is not sucked from the nozzle. Since the fluid passage is sealed, a large negative pressure can be applied to the liquid adhering to the fluid passage. The liquid adhering to the fluid passage can consequently be removed efficiently.

BRIEF DESCRIPTION OF THE DRAWINGS

FIG. 9 shows figures for describing S2 to S4 of FIG. 8.

FIG. 10 shows figures for describing S5 to S8 of FIG. 8.

FIG. 12 shows figures for describing the flowchart of FIG. 11.

FIG. 15 shows figures for describing how the sucking process is executed utilizing the seal member of FIG. 14.

DETAILED DESCRIPTION OF THE INVENTION

Embodiment

Figure 1:
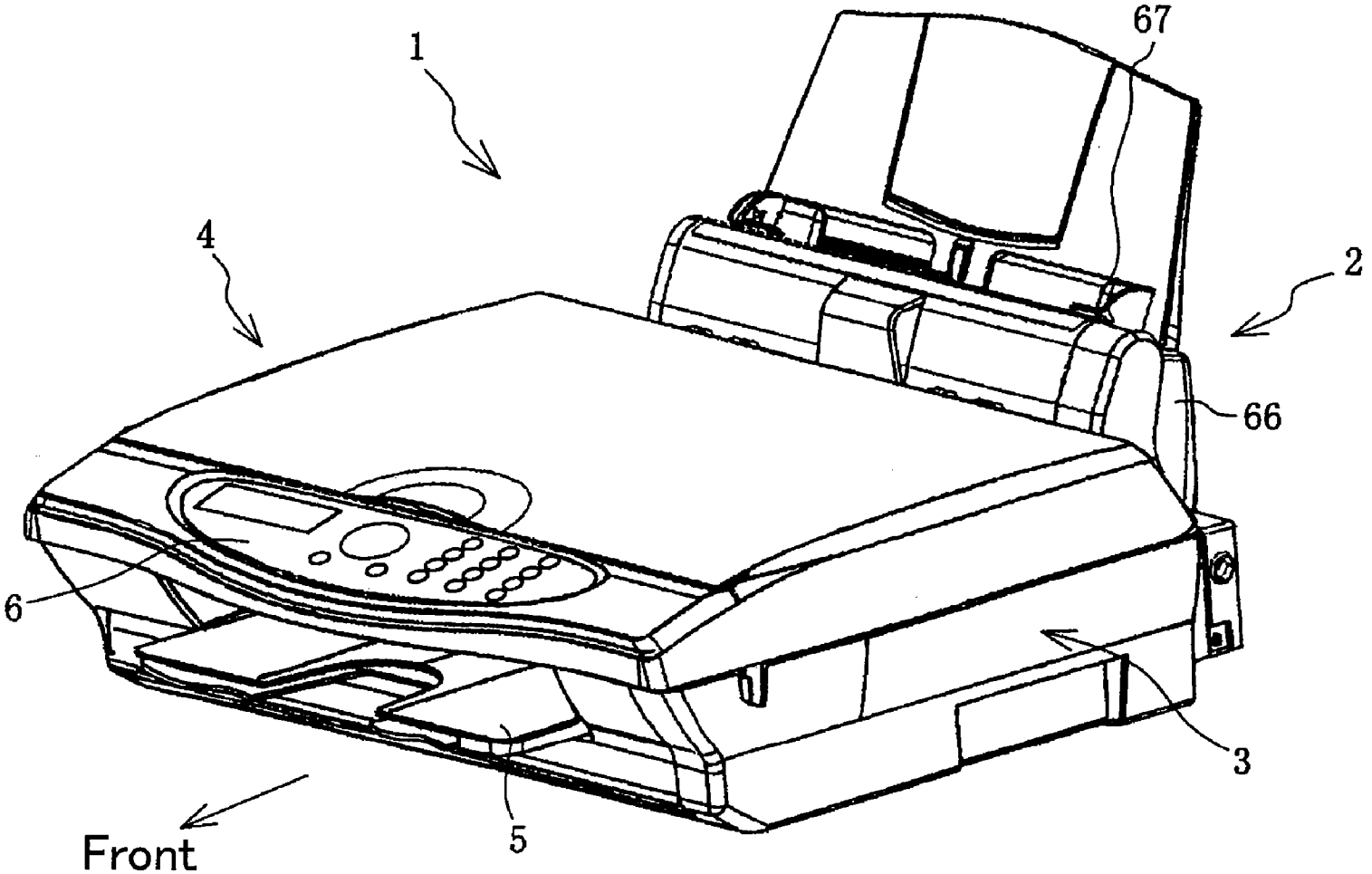
FIG. 1 shows a perspective view of a multi-function device of the present embodiment.

An embodiment of the present invention will be described in detail below with reference to the figures. FIG. 1 shows a perspective view of a multi-function device of the present embodiment. A multi-function device 1 of the present embodiment is provided with a printing function, a copy function, a scanner function, a fax function, a telephone function, etc.

(Configuration of the Multi-Function Device)

The multi-function device 1 includes a paper supply device 2, a printer 3, a scanner 4, a paper discharge tray 5, an operation panel 6, etc.

The paper supply device 2 is disposed at a rear end part of the multi-function device 1.

The printer 3 is disposed below the paper supply device 2. The printer 3 is disposed to the front of the paper supply device 2. The printer 3 is an ink jet type printer.

The scanner 4 is disposed above the printer 3. The scanner 4 is utilized for executing the copy function and the fax function.

The paper discharge tray 5 is disposed to the front of the printer 3.

The operation panel 6 is disposed to the front of the scanner 4.

The paper supply device 2 includes an inclined wall part 66, a guide plate 67, etc. The inclined wall part 66 holds printing paper (corresponding to a print medium) in an inclined state. The guide plate 67 is removably attached to the inclined wall part 66.

The paper supply device 2 can hold a plurality of sheets of paper. A paper supply motor and a paper supply roller (not shown), etc. are contained within the inclined wall part 66. The paper supply roller is rotated by driving force of the paper supply motor. The paper supply roller transports paper held in the paper supply device 2 toward the printer 3.

(Configuration of the Printer)

Figure 2:
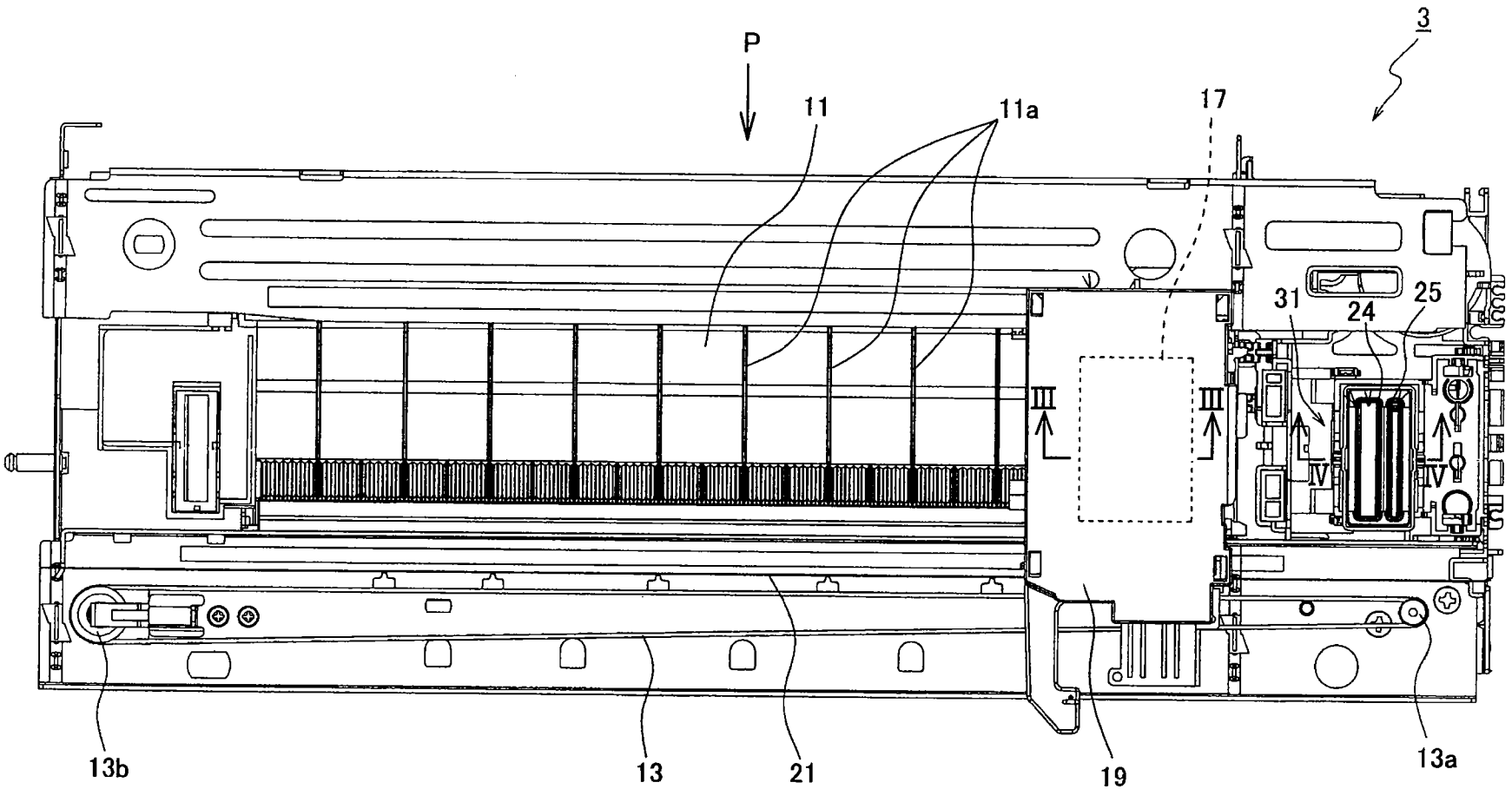
FIG. 2 shows a plan view of the interior of the multi-function device.

The configuration of the printer 3 will be described. FIG. 2 shows a plan view of the interior of the printer 3. The printer 3 includes a platen 11, etc. The paper is transported to above the platen 11. A plurality of ribs 11*a* are formed in a parallel manner on a surface of the platen 11. The ribs 11*a* support the paper. The paper is transported in the direction of the arrow P by the paper supply roller (not shown).

The printer 3 includes a belt 13, a carriage motor 15, a pair of pulleys 13*a* and 13*b*, a head 17, a carriage 19, a maintenance device 31, etc.

The belt 13 is disposed to the front of the platen 11. The belt 13 extends along the widthwise direction of the paper (the left-right direction in FIG. 2). The belt 13 is suspended across the pair of pulleys 13*a* and 13*b*.

Figure 7:
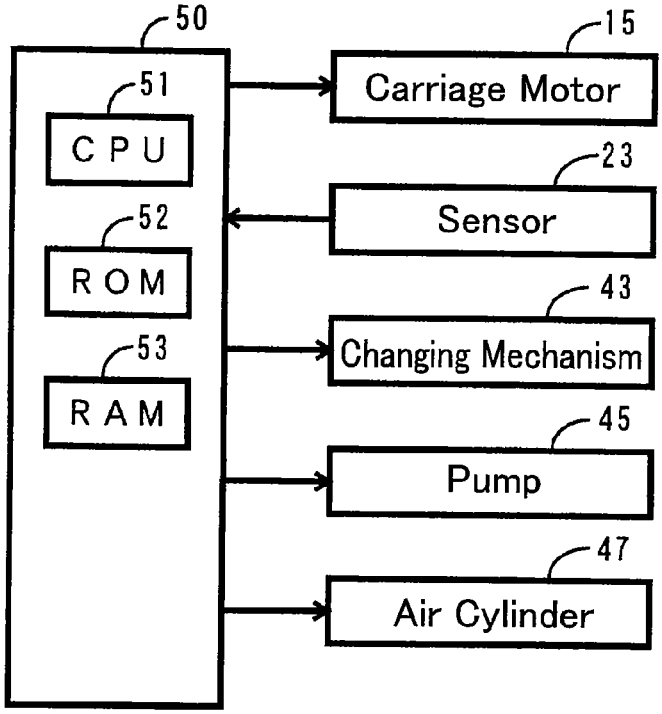
FIG. 7 shows a simplification of a control configuration of the multi-function device.

The pulley 13*a* is a driving pulley that is driven by the carriage motor 15 (see FIG. 7). The pulley 13*b* is a driven pulley that follows the rotation of the belt 13.

The carriage 19 is fixed to the belt 13. The head 17 is fixed to the carriage 19. When the carriage motor 15 is driven, the carriage 19 moves in the left-right direction above the platen 11.

Furthermore, an encoder strip 21 having a plurality of slits formed therein is disposed between the platen 11 and the belt 13. A sensor 23 (see FIG. 7) for optically detecting the slits of the encoder strip 21 is formed on the carriage 19. The location of the carriage 19 can be calculated using the sensor 23.

Four tubes (not shown) for supplying ink are connected to a right end and a left end of the head 17. Further, four ink tanks (not shown) are disposed below the platen 11. Ink of differing colors (magenta, yellow, cyan, and black) is housed in these ink tanks. Each of the aforementioned tubes is connected to a corresponding one of the ink tanks.

Figure 3A:
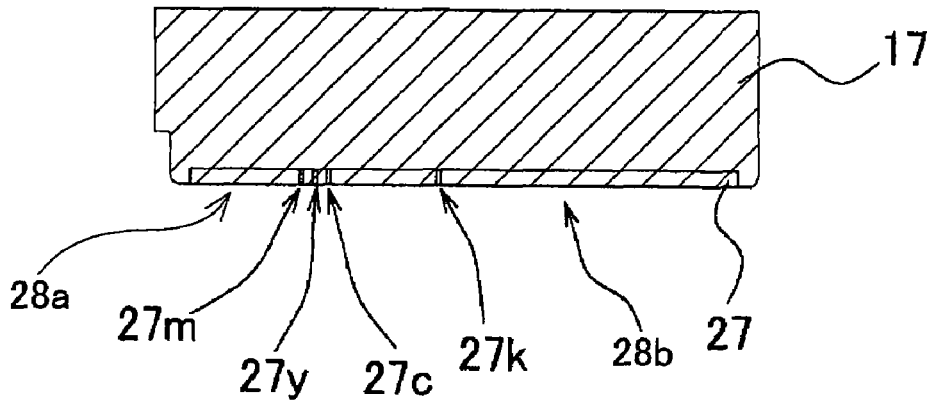
FIG. 3A shows a cross-sectional view along the line III-III of FIG. 2.

The head 17 can discharge ink supplied from the ink tanks from nozzles 27*m*, 27*y*, 27*c*, and 27*k* (see FIG. 3A). A color image is thus formed on the paper. The paper that has had an image formed thereon using ink is transported by a transporting roller (not shown). The paper that has been transported is ejected to the paper discharge tray 5 (see FIG. 1) by a paper discharge roller (not shown).

(Configuration of the Head)

Figure 3B:
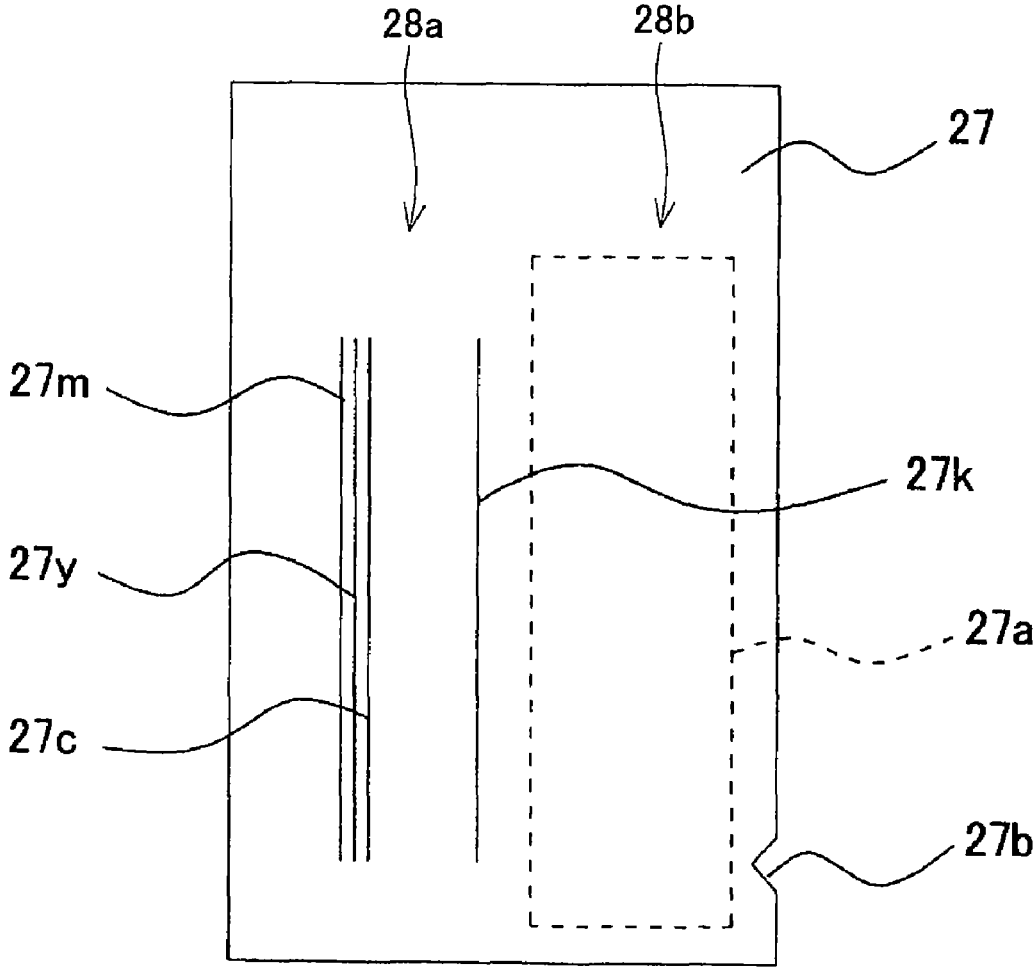
FIG. 3B shows a plan view of a head viewed from below FIG. 3A.

FIG. 3A is a cross-sectional view along the line III-III of FIG. 2. That is, FIG. 3A is a cross-sectional view of the head 17. FIG. 3B shows a plan view of the head 17 viewed from below FIG. 3A.

The head 17 has a nozzle plate 27. The nozzle plate 27 forms a lowermost surface of the head 17. The nozzles 27*m*, 27*y*, 27*c*, and 27*k* are formed in the nozzle plate 27. A bottom surface of the nozzle plate 27 has a nozzle plane 28*a* in which the nozzles 27*m*, etc. are formed, and a non-nozzle plane 28*b* in which the nozzles 27*m*, etc. are not formed. The nozzle plane 28*a* and the non-nozzle plane 28*b* are formed on the same plate 27.

In FIG. 3B, the nozzles 27*m* can be seen as one straight line. However, the nozzles 27*m* are composed of a plurality of round holes that are aligned in a linear shape. Similarly, the nozzles 27*y*, 27*c*, and 27*k* are also composed of a plurality of holes aligned in a linear shape. The nozzles 27*m*, 27*y*, 27*c*, and 27*k* are disposed in a parallel manner. The nozzles 27*m*, 27*y*, and 27*c* are disposed close to one another in the left-right direction of FIG. 3B. The nozzles 27*k* and the nozzles 27*c* are disposed far from one another.

When a piezoelectric actuator (not shown) is driven, ink droplets (magenta, yellow, cyan, and black) are discharged from the nozzles 27*m*, etc.

The non-nozzle plane 28*b* of the nozzle plate 27 is disposed to the right of the nozzle plane 28*a*. The non-nozzle plane 28*b* has approximately the same plan surface shape and size as a cap unit 26 (see FIG. 4B). The non-nozzle plane 28*b* contains a seal region 27*a* (to be described).

A triangular notch 27*b* is formed at a right end of the nozzle plate 27.

(Configuration of the Maintenance Device)

Figure 4A:
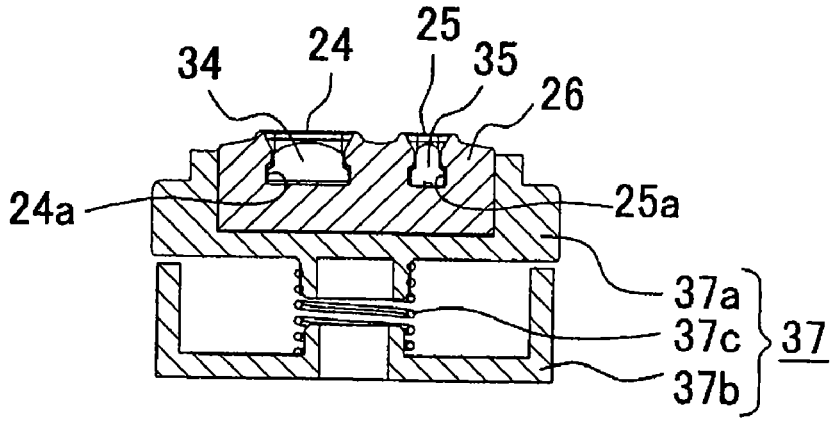
FIG. 4A shows a cross-sectional view along the line IV-IV of FIG. 2.
Figure 4B:
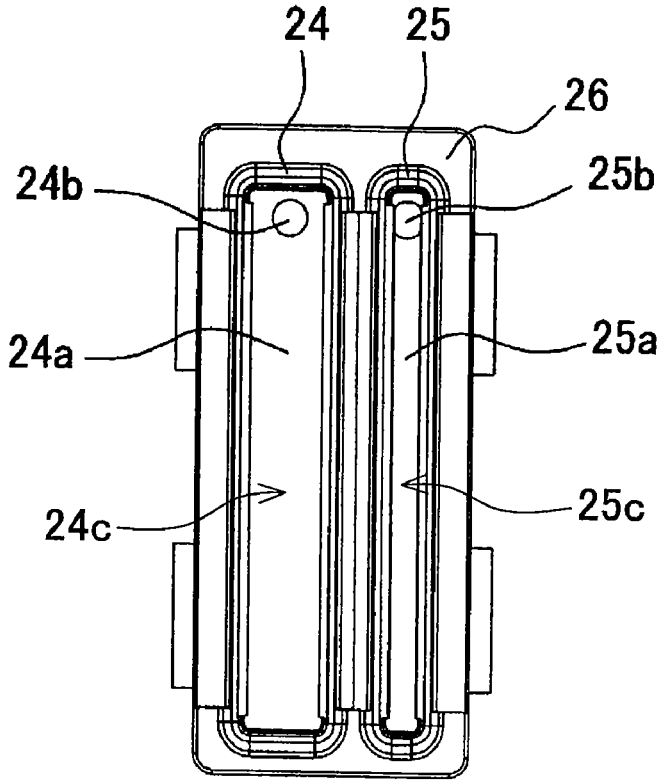
FIG. 4B shows a plan view of a cap unit viewed from above FIG. 4A.

FIG. 4A shows a cross-sectional view along the line IV-IV of FIG. 2. That is, FIG. 4A shows a cross-sectional view of the maintenance device 31. FIG. 4B shows a plan view of the maintenance device (the cap unit) 31 viewed from above FIG. 4A. FIG. 4B shows only the cap unit 26 (to be described), and other parts are omitted.

The maintenance device 31 is disposed to the right of the platen 11. The maintenance device 31 includes the cap unit 26, a cap holder 37, a changing mechanism 43, a pump 45, an air cylinder 47, etc.

The cap unit 26 is formed integrally from a resilient material such as rubber. The cap unit 26 has two caps 24 and 25. The cap 24 has a concave portion 24*a* capable of covering the surroundings of the nozzles 27*m*, 27*y*, and 27*c*. The cap 25 has a concave portion 25*a* capable of covering the surroundings of the nozzles 27*k*.

A cap chip 34 is fixed to an inner part of the concave portion 24*a*. The cap chip 34 has a circular arc shape in cross-section.

The cap chip 34 fits closely with a bottom surface of the concave portion 24*a*. The cap chip 34 consists of resin capable of easily repelling ink. Similarly, a cap chip 35 is fixed to an inner part of the concave portion 25*a*.

The cap unit 26 is fixed to the cap holder 37. The cap holder 37 includes an upper member 37*a*, a lower member 37*b*, and a compressed coil spring 37*c*. The compressed coil spring 37*c* is disposed between the upper member 37*a* and the lower member 37*b*. The cap unit 26 fits into the upper member 37*a* of the cap holder 37.

As shown in FIG. 4B, the caps 24 and 25 (the concave portions 24*a* and 25*a*) extend in the direction in which the nozzles 27*m* etc. extend (the up-down direction in FIG. 3B and FIG. 4B).

A suction opening 24*b* is formed in the bottom surface of the concave portion 24*a* of the cap 24. The suction opening 24*b* is disposed close to one end of the concave portion 24*a* (the upper end in FIG. 4B).

Similarly, a suction opening 25*b* is formed in the bottom surface of the concave portion 25*a* of the cap 25. The suction opening 25*b* is disposed close to one end of the concave portion 25*a* (the upper end in FIG. 4B).

Figure 5:
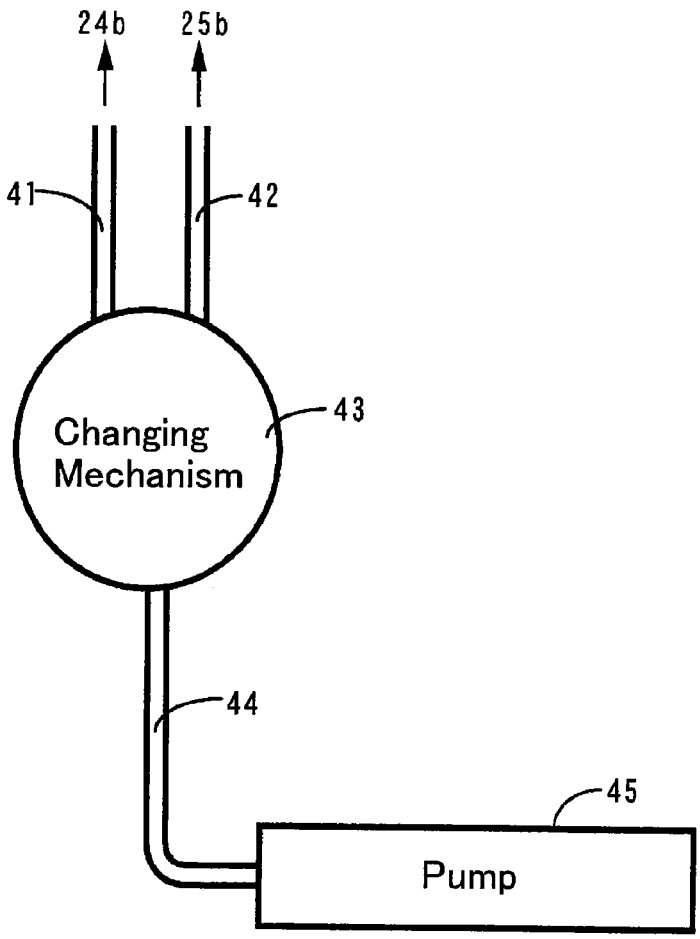
FIG. 5 shows a simplification of a pump and a changing mechanism.

FIG. 5 shows a simplification of the pump 45 and the changing mechanism 43 both of which are connected to the suction openings 24*b* and 25*b*.

The suction opening 24*b* is connected to the changing mechanism 43 via a tube 41. The suction opening 25*b* is connected to the changing mechanism 43 via a tube 42. One end of a tube 44 is connected to the changing mechanism 43. The other end of the tube 44 is connected to the pump 45.

The changing mechanism 43 can change between a first mode, a second mode, and a third mode. In the first mode, negative pressure generated by the pump 45 is supplied to the tubes 41 and 42. In the second mode, the negative pressure is supplied only to the tube 41. In the third mode, the negative pressure is supplied only to the tube 42.

When the pump 45 is driven in the second mode, negative pressure is supplied to the concave portion 24*a*, the opening 24*b*, the tube 41, the changing mechanism 43, and the tube 44. The concave portion 24*a*, the opening 24*b*, the tube 41, the changing mechanism 43, and the tube 44 thus form a passage for fluid (ink, air, etc.). Below, this fluid passage will be represented by the number 24*c* (see FIG. 4B). The concave portion 24*a* is formed at one end of the fluid passage 24*c*. Furthermore, the tube 44 is formed at the other end of the fluid passage 24*c*.

When the pump 45 is driven in the third mode, negative pressure is supplied to the concave portion 25*a*, the opening 25*b*, the tube 42, the changing mechanism 43, and the tube 44. The concave portion 25*a*, the opening 25*b*, the tube 42, the changing mechanism 43, and the tube 44 thus form a passage for fluid (ink, air, etc.). Below, this fluid passage will be represented by the number 25*c* (see FIG. 4B). The concave portion 25*a* is formed at one end of the fluid passage 25*c*. Furthermore, the tube 44 is formed at the other end of the fluid passage 25*c*.

Figure 6:
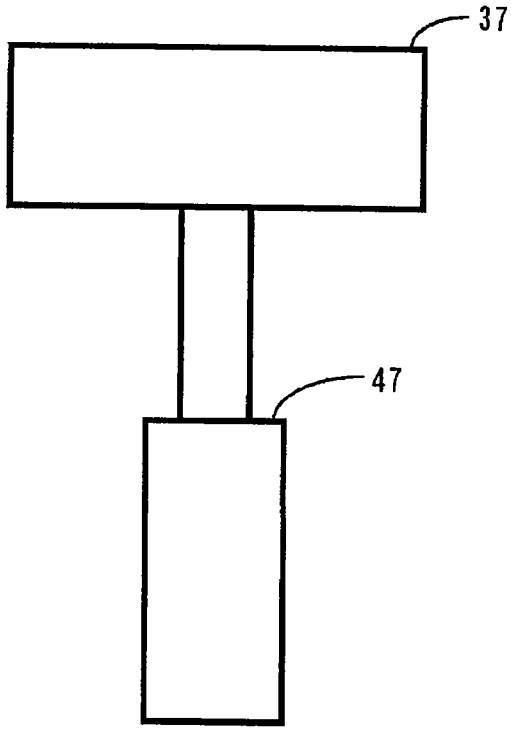
FIG. 6 shows a simplification of a mechanism for raising and lowering the cap unit.

FIG. 6 shows a simplification of the cap holder 37 and the air cylinder 47. The air cylinder 47 is connected to a bottom end part of the cap holder 37. The air cylinder 47 can raise and lower the cap holder 37. When the cap holder 37 is raised, the caps 24 and 25 make contact with the nozzle plate 27. When the cap holder 37 is lowered, the caps 24 and 25 are away from the nozzle plate 27.

(Control Configuration)

Next, a control configuration of the multi-function device 1 will be described. FIG. 7 shows a simplification of the control configuration of the multi-function device 1. The multi-function device has a control circuit 50.

The control circuit 50 is a microcomputer that has a CPU 51, a ROM 52, a RAM 53, etc. The carriage motor 15, the sensor 23, the changing mechanism 43, the pump 45, and the air cylinder 47 are connected to the control circuit 50. The control circuit 50 executes a process to suck out the ink within the nozzles 27*m*, 27*y*, 27*c*, and 27*k* with a predetermined timing. For example, the control circuit 50 may execute the above process regularly or irregularly (in the case where printing has not been performed for a long period). Further, the control circuit 50 may also execute the above process when a user inputs a predetermined command via the operation panel 6.

(Process Executed by the Control Circuit)

Figure 8:
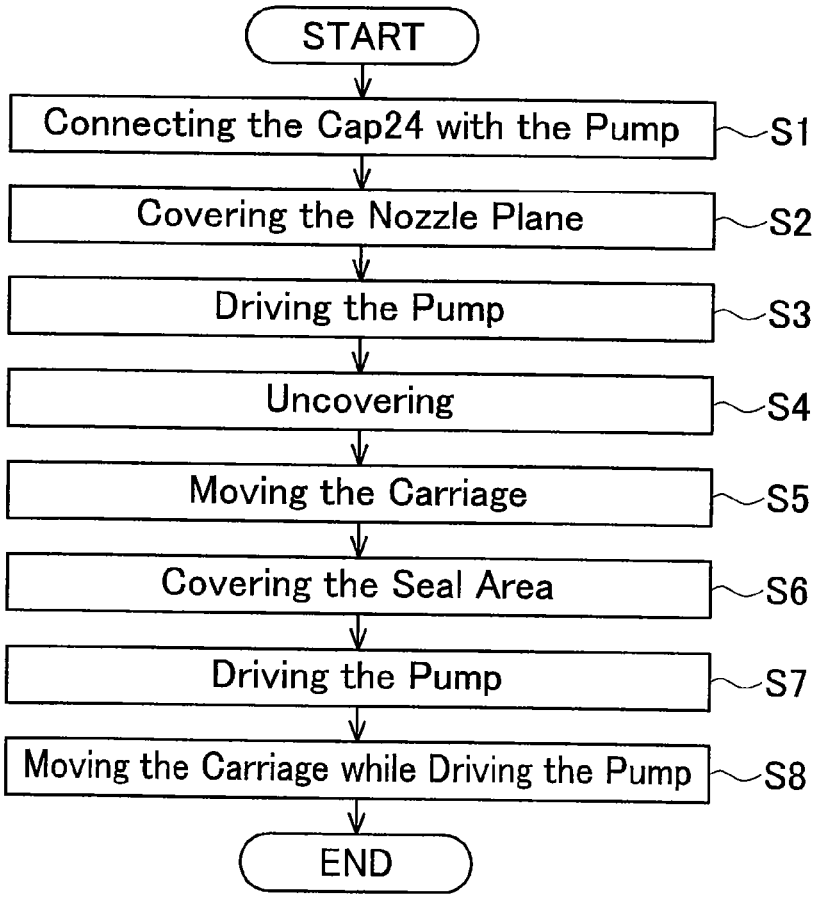
FIG. 8 shows a flowchart of a sucking process for nozzles for color ink.

Next, the sucking process executed by the control circuit 50 will be described. FIG. 8 shows a flowchart of the sucking process for the nozzles 27*m*, 27*y*, and 27*c* for color ink.

The control circuit 50 changes the mode of the changing mechanism 43 to the second mode (S1). The pump 45 is thus connected with only the cap 24.

Figure 9A:
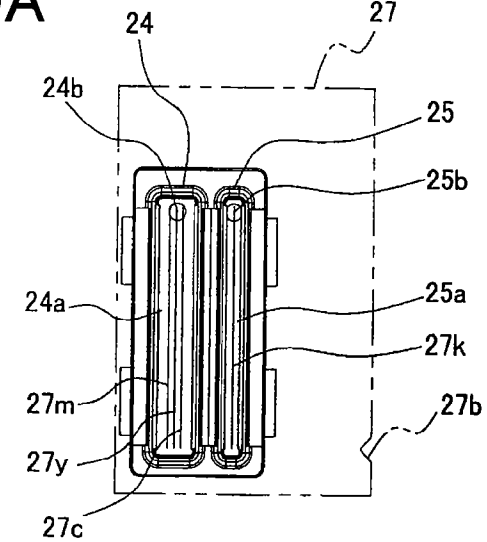
FIG. 9A shows a plan view of the cap unit.
Figure 9B:
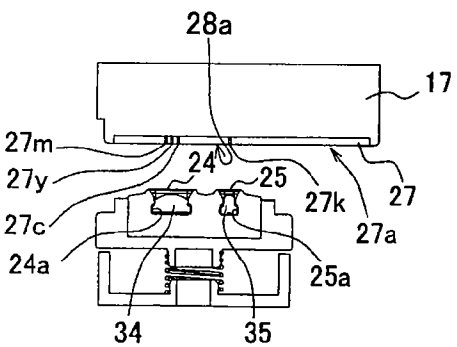
FIG. 9B shows a cross-sectional view of the head and the cap unit.

In S2, the sensor 23 reads the slits of the encoder strip 21. The carriage motor 15 is driven based on the results detected by the sensor 23. The concave portion 24*a* thus faces the nozzles 27*m*, 27*y*, and 27*c*, and the concave portion 25*a* faces the nozzles 27*k*. That is, the caps 24 and 25 face the nozzle plane 28*a* of the head 17. This state is shown in FIGS. 9A and 9B.

Figure 9C:
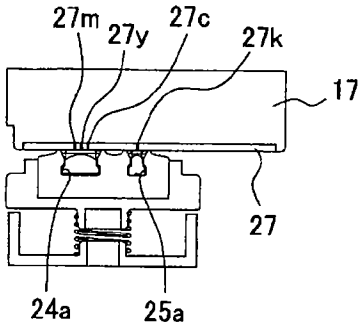
FIG. 9C shows the cap unit after it has been raised.

Next, the air cylinder 47 is driven. The caps 24 and 25 are raised. The cap 24 thus makes contact with the nozzle plane 28*a*, and the nozzles 27*m*, 27*y*, and 27*c* are covered by the cap 24. In this state, the nozzles 27*m*, 27*y*, and 27*c* communicate with the fluid passage 24*c*. Further, the cap 25 makes contact with the nozzle plane 28*a*, and the nozzles 27*k* are covered by the cap 25. In this state, the nozzles 27*k* communicate with the fluid passage 25*c*. This state is shown in FIG. 9C.

Figure 9D:
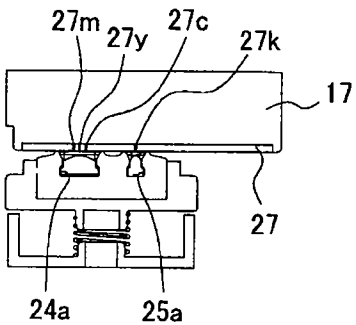
FIG. 9D shows a state where the pump is being driven.

In S3, the pump 45 is driven and supplies negative pressure. Air within the interior of the concave portion 24*a* is thus sucked out. The ink within the nozzles 27*m*, 27*y*, and 27*c* is thus sucked out. The ink that has been sucked out passes along the fluid passage 24*c* and is removed. Moreover, negative pressure is not supplied to the fluid passage 25*c* at this juncture. FIG. 9D shows S3 being executed.

Figure 9E:
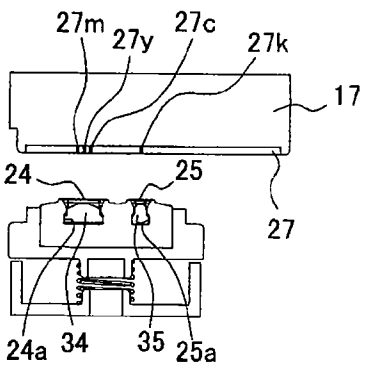
FIG. 9E shows the cap unit after it has been lowered.

Next, in S4, the air cylinder 47 is driven. The caps 24 and 25 are lowered. The nozzles 27*m*, 27*y*, and 27*c* are thus uncovered. This state is shown in FIG. 9E.

Figure 10E:
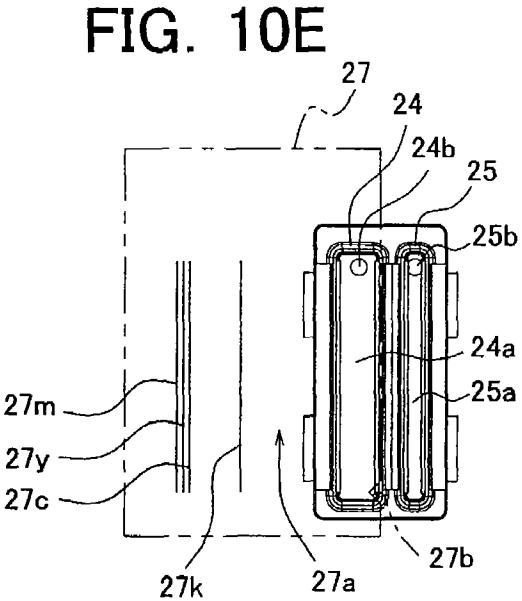
FIG. 10E shows a plan view of the cap unit.
Figure 10F:
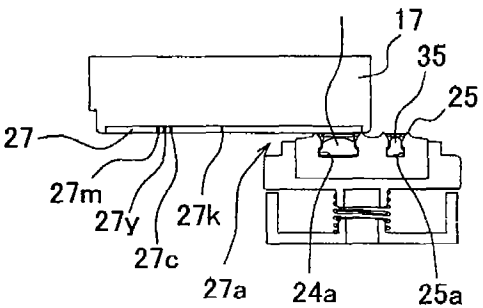
FIG. 10F shows a state after a carriage has been moved from the state in FIG. 10D.
Figure 10D:
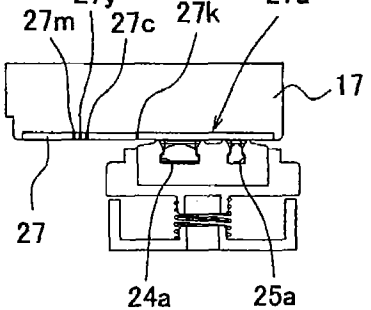
FIG. 10D shows a state where the pump is being driven.
Figure 10C:
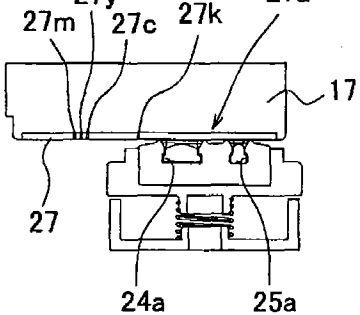
FIG. 10C shows the cap unit after it has been raised.
Figure 10A:
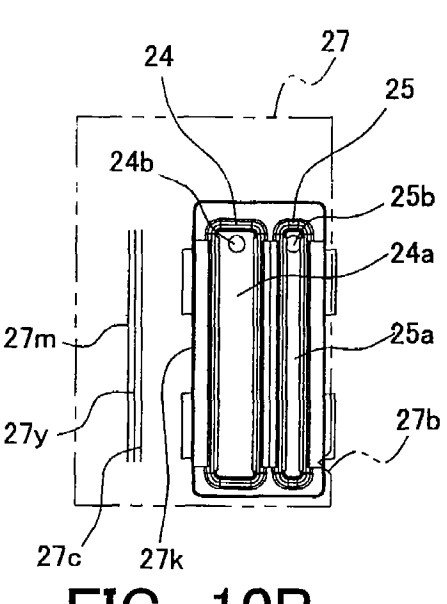
FIG. 10A shows a plan view of the cap unit.
Figure 10B:
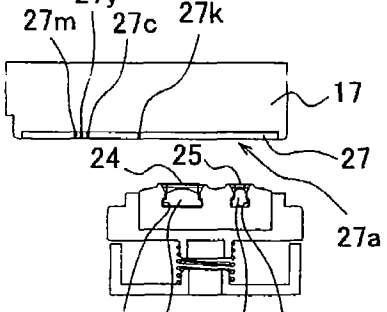
FIG. 10B shows a cross-sectional view of the head and the cap unit.

In S5, the head 17 moves based on the encoder strip 21. The caps 24 and 25 face the seal region 27*a* (see FIG. 3B, etc.). This state is shown in FIGS. 10A and 10B.

Next, in S6, the air cylinder 47 is driven. The caps 24 and 25 are raised. The caps 24 and 25 thus make contact with the non-nozzle plane 28*b* (see FIG. 3B). That is, the caps 24 and 25 are sealed by the seal region 27*a*. In this state, the nozzles 27*m*, 27*y*, 27*c*, and 27*k* are disposed away from the concave portions 24*a* and 24*b*. That is, the caps 24 and 25 are not facing the nozzles 27*m*, etc. "The nozzles being disposed away from the concave portions" refers to a state wherein ink is not sucked out of the nozzles even though the pump 45 is being driven and negative pressure is being supplied. The concave portions 24*a* and 24*b* are completely sealed as a closed space. This state is shown in FIG. 10C.

In S7, the pump 45 is driven. Negative pressure is thus supplied to the fluid passage 24*c*. That is, vacuum sucking is executed in the fluid passage 24*c*. The ink, etc. that has adhered to the fluid passage 24*c* (particularly the concave portion 24*a*) in S3 is removed. At this time, negative pressure is not supplied to the fluid passage 25*a*. FIG. 10D shows S7 being executed.

In S8, the carriage motor 15 is driven while the pump 45 continues to be driven. The head 17 moves to the left with respect to the caps 24 and 25. FIGS. 10E and 10F show the movement of the head 17. The head 17 moves to a position completely away from the caps 24 and 25. The process thus ends.

The process of S8 will be described in a little more detail. The process of S8 is executed while the pump 45 is continuing to be driven. In this state, the negative pressure is maintained within the fluid passage 24*c* (the concave portion 24*a*, the suction opening 24*b*, the tube 41, the changing mechanism 43, and the tube 44). When the head 17 moves to the left while the negative pressure is being maintained within the fluid passage 24*c*, the notch 27*b* faces the concave portion 24*a*, as shown in FIG. 10E. In this state, the seal region 27*a* does not seal a portion of the concave portion 24*a* (the portion corresponding to the notch 27*b*). In this case, air flows into the fluid passage 24*c* from the notch 27*b*, and atmospheric pressure is applied to the ink adhering to the fluid passage 24*c* (and in particular to the concave portion 24*a*). The ink adhering to the fluid passage 24*c* is removed.

A flow of atmospheric air from the notch 27*b* toward the suction opening 24*b* is generated. As described above, the suction opening 24*b* is disposed close to an upper end of the cap 24 in FIG. 10E. The notch 27*b* is disposed close to a bottom end of the cap 24 in FIG. 10E. As a result, the atmospheric air flow from bottom to top in FIG. 10E crosses approximately the entire range of the concave portion 24*a*. The ink adhering to the concave portion 24*a* can be removed efficiently.

The state shown in FIGS. 10E and 10F can be termed partially sealing the fluid passage 24*c* (the concave portion 24*a*). In the present embodiment, it can be said that the negative pressure is being supplied to the partially sealed fluid passage 24*c*.

Furthermore, the cap chip 34 is disposed in the concave portion 24*a*. As a result, the atmospheric air flow can be rectified, and the ink can be removed more efficiently.

The pump 45 continues to be driven for a period sufficient for removing the ink. Then the pump 45 is halted.

Figure 11:
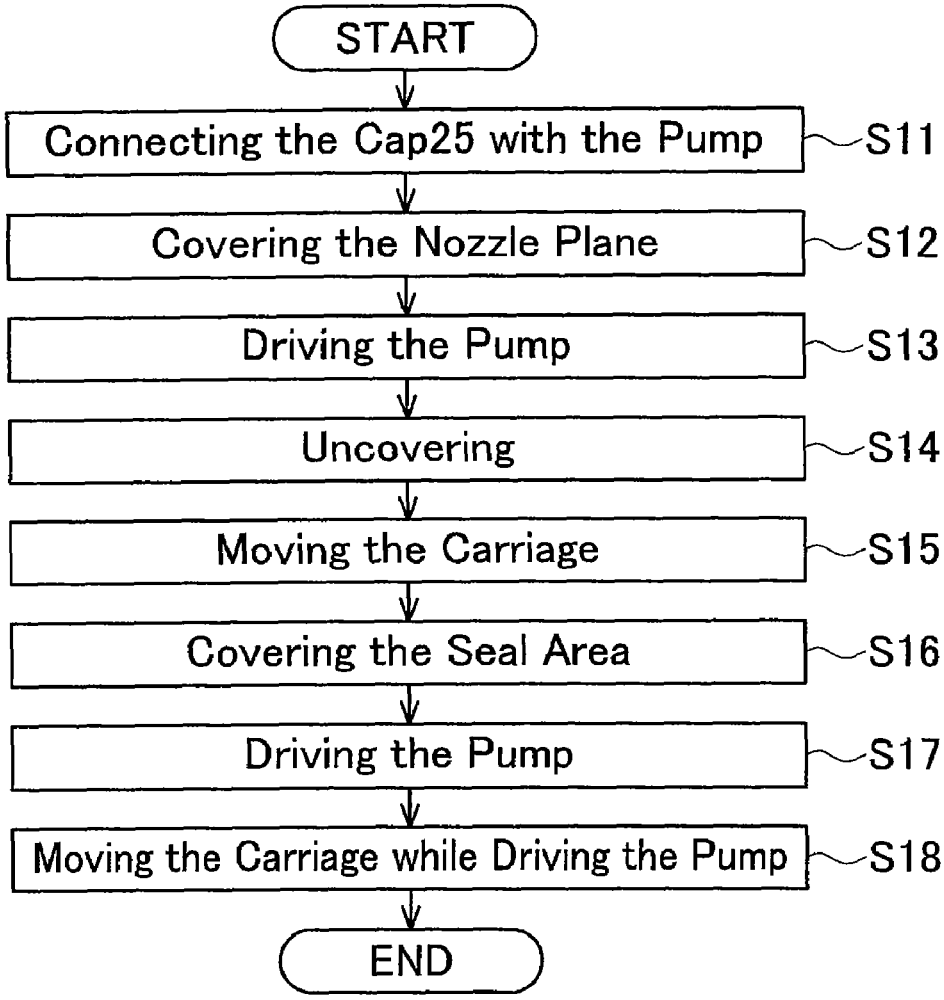
FIG. 11 shows a flowchart of a sucking process for nozzles for black ink.

FIG. 11 shows a flowchart of the sucking process for the nozzles 27*k* for black ink.

In this process, the mode of the changing mechanism 43 is changed to the third mode in S11. The pump 45 is thus connected with the cap 25. Apart from this point, the process is the same as that of FIG. 8.

That is, in S12, the nozzles 27*m*, 27*y*, 27*c*, and 27*k* are covered by the caps 24 and 25. In S13, the pump 45 is driven, and the ink within the nozzles 27*k* is thus sucked out.

In S14, the nozzles 27*m*, 27*y*, 27*c*, and 27*k* are uncovered. In S15, the head 17 moves. In S16, the caps 24 and 25 are sealed by the seal region 27*a*. The concave portion 25*a* is completely sealed as a closed space while the nozzles 27*m*, 27*y*, 27*c*, and 27*k* are disposed away from the concave portion 25*a*. This state wherein "the nozzles are disposed away from the concave portion" refers to a state wherein ink is not sucked out of the nozzles even though the pump 45 is being driven. In S17, the pump 45 is driven. Negative pressure is thus supplied to the fluid passage 25*c*. That is, vacuum sucking is executed in the fluid passage 25*c*. In S18, the carriage motor 15 is driven while the pump 45 continues to be driven. The head 17 (the seal region 27*a*) thus moves, and the process ends.

Figure 12A:
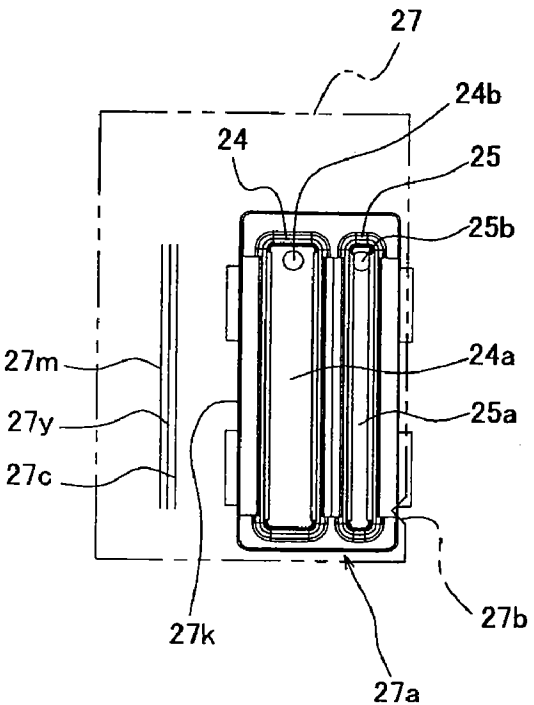
FIG. 12A shows a plan view of the cap unit.
Figure 12B:
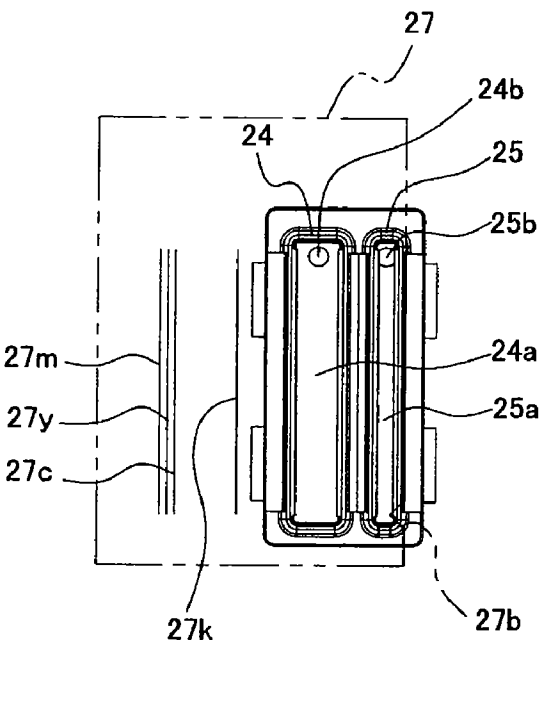
FIG. 12B shows a state after the carriage has been moved from the state in FIG. 12A.

In S17, negative pressure is supplied to the fluid passage 25*c*. This state is shown in FIG. 12A. When the seal region 27*a* has been moved to the left from the state in FIG. 12A, the state shown in FIG. 12B is reached. The notch 27*b* faces the cap 25, and air consequently flows into the fluid passage 25*c*. Atmospheric pressure is applied to the ink adhering to the fluid passage 25*c*, and consequently the ink adhering to the fluid passage 25*c* can be removed efficiently. The notch 27*b* is disposed close to a bottom end of the cap 25 in FIG. 12B, and the suction opening 25*b* is disposed close to an upper end of the cap 25 in FIG. 12B. As a result, an atmospheric air flow is generated from the notch 27*b* to the suction opening 25*b*. The ink adhering to the concave portion 25*a* can be removed efficiently.

Figure 12C:
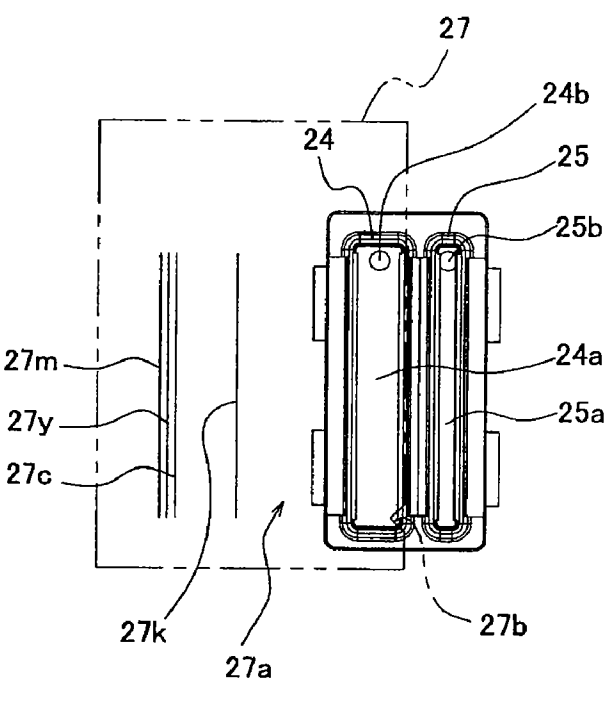
FIG. 12C shows a state after the carriage has been moved from the state in FIG. 12B.

Moreover, when the seal region 27*a* is moved further to the left, the concave portion 24*a* faces the notch 27*b*. That is, the state shown in FIG. 12C is reached. Negative pressure is not being applied to the concave portion 24*a*, and consequently there is no air flowing into the concave portion 24*a*.

The state shown in FIG. 12B can be termed partially sealing the fluid passage 25*c*. In the present embodiment, it can be said that the negative pressure is being supplied to the partially sealed fluid passage 25*c*.

Figure 13:
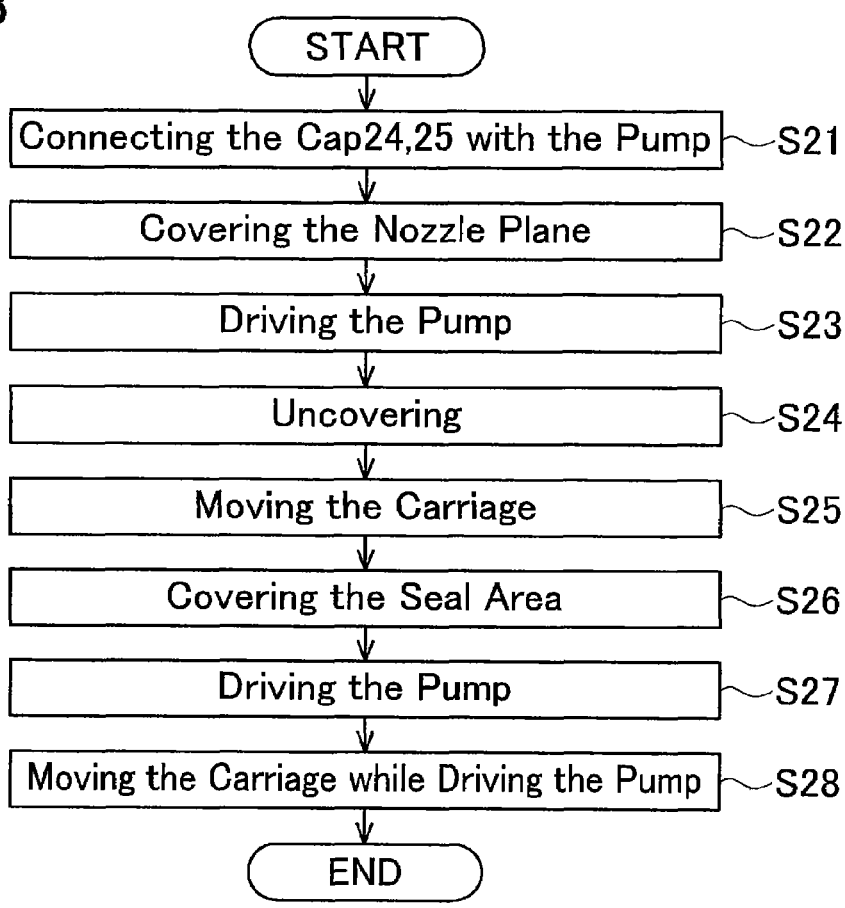
FIG. 13 shows a flowchart of a sucking process for all nozzles.

FIG. 13 shows a flowchart of the sucking process for both of the nozzles 27*m*, 27*y*, 27*c* for color ink and the nozzles 27*k* for black ink.

In S21, the mode of the changing mechanism 43 is changed to the first mode. The pump 45 is thus connected with both the cap 24 and the 25. Apart from this point, the process is the same as that of FIG. 8.

That is, in S22, the nozzles 27*m*, 27*y*, 27*c*, and 27*k* are covered by the caps 24 and 25. In S23, the pump 45 is driven, and the ink within all the nozzles 27*m*, 27*y*, 27*c*, and 27*k* is sucked out.

In S24, the nozzles 27*m*, 27*y*, 27*c*, and 27*k* are uncovered. In S25, the head 17 moves. In S26, the caps 24 and 25 are sealed by the seal region 27*a*. The concave portions 24*a* and 25*a* are completely sealed as a closed space while the nozzles 27*m*, 27*y*, 27*c*, and 27*k* are disposed away from the concave portions 24*a* and 25*a*. This state wherein "the nozzles are disposed away from the concave portions" refers to a state wherein ink is not sucked out of the nozzles even though the pump 45 is being driven. In S27, the pump 45 is driven. Negative pressure is thus supplied to the fluid passages 24*c* and 25*c*. In S28, the carriage motor 15 is driven while the pump 45 continues to be driven. The head 17 (the seal region 27*a*) thus moves, and the process ends.

In S27, negative pressure is supplied to the fluid passages 24*c* and 25*c*. When the concave portion 25*a* is facing the notch 27*b* (the state shown in FIG. 12B), air flows into the fluid passage 25*c*. When the concave portion 24*a* is facing the notch 27*b*, air flows into the fluid passage 24*c*.

With the present embodiment, as described above, ink adhering to the fluid passages 24*c* and 25*c* can be removed efficiently.

The technical concept of the present invention is not limited to the above embodiment. The present invention can be embodied in various ways within a range that does not deviate from the substance thereof.

For example, the notch 27*b* may equally well be a through hole.

Furthermore, for example, in the case where the suction opening of the concave portion is disposed in the center of the concave portion, two notches may be formed in the concave portion. In this case, it is preferred that one of the notches is disposed at one end side of the concave portion in a longitudinal direction, and that the other of the notches is disposed at the other end side of the concave portion in the longitudinal direction.

Figure 14:
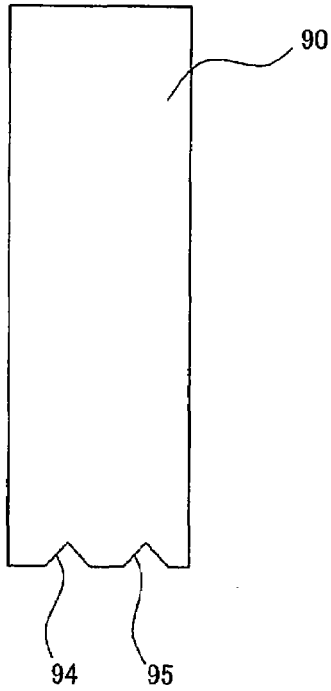
FIG. 14 shows a variant seal member.

The seal region 27*a* may equally well be separate from the head 17 (the carriage 19). FIG. 14 shows a plan view of this type of seal plate 90. The seal plate 90 may be disposed above the cap unit 26. The seal plate 90 may be capable of moving in a front-rear direction (a direction perpendicular to the plane of the page in FIG. 15A). Notches 94 and 95 are formed in a front of the seal plate 90. The notches 94 and 95 can face the concave portions 24*a* and 25*a*.

Figure 15A:
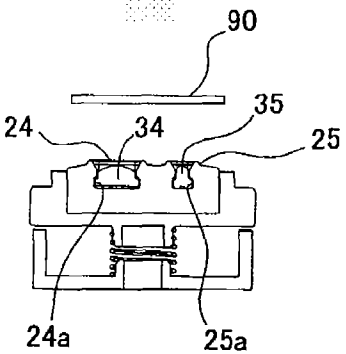
FIG. 15A shows a cross-sectional view of the seal member and the cap unit.
Figure 15C:
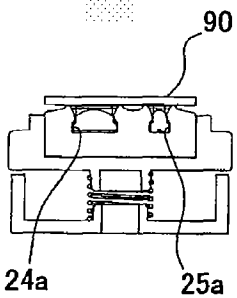
FIG. 15C shows a state after the cap unit has been raised.
Figure 15D:
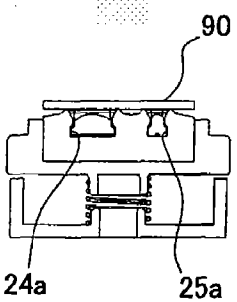
FIG. 15D shows a state where the pump is being driven.
Figure 15E:
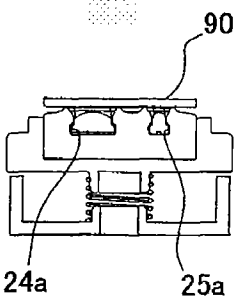
FIG. 15E shows a state after the seal member has been moved from the state in FIG. 15D.
Figure 15B:
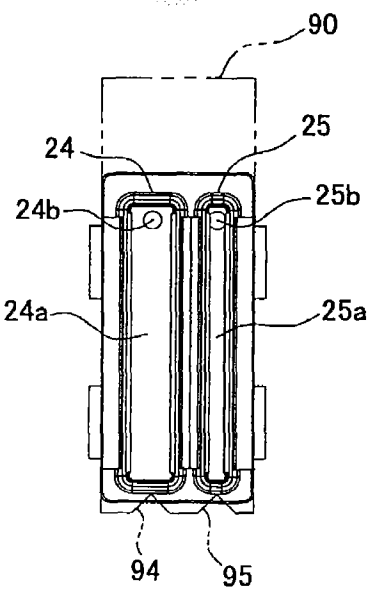
FIG. 15B shows a plan view of the cap unit.

When the seal plate 90 is located in the position shown in FIGS. 15A and 15B, the entire plane of the seal plate 90 is facing the concave portions 24*a* and 25*a*. In this state, the notches 94 and 95 are not facing the concave portions 24*a* and 25*a*. When the caps 24 and 25 are raised, the concave portions 24*a* and 24*b* are completely sealed as a closed space. This state is shown in FIG. 15C.

In this state, the pump 45 is driven. Negative pressure can be supplied to both or one of the closed spaces. FIG. 15D shows the pump 45 being driven.

Figure 15F:
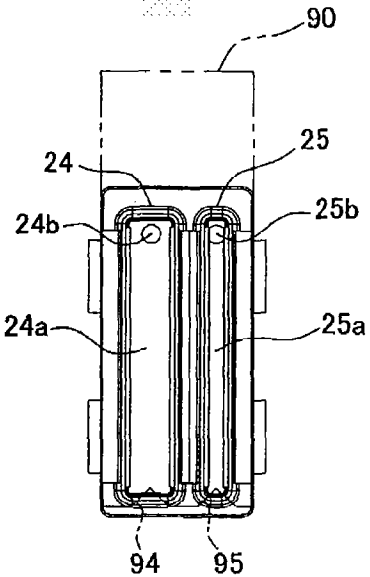
FIG. 15F shows a state after the seal member has been moved from the state in FIG. 15D.

As shown in FIGS. 15E and 15F, the seal plate 90 is moved, and the notches 94 and 95 face the concave portions 24*a* and 25*a*. In this case, air flows via the notches 94 and 95 to the closed spaces to which the negative pressure is being supplied (the fluid passage 24*c* and/or the fluid passage 25*c*). The ink adhering to the fluid passages 24*c* and 25*c* is thus removed efficiently.

The configuration is simplified in the case where the seal member and the nozzle plate 27 are integral, and consequently manufacturing cost can be reduced. Alternatively, in the case where the seal member and the head are formed as separate parts, ink removal can be performed even during printing.

What is claimed is:

1. A liquid discharge device, comprising:

a head comprising a nozzle plane in which a nozzle for discharging liquid is formed;

a cover member comprising a fluid passage, the cover member being capable of covering the nozzle plane such that one end of the fluid passage is in communication with the nozzle;

a negative pressure source connected to the fluid passage;

a seal member comprising a non-nozzle plane in which the nozzle is not formed, the non-nozzle plane being capable of sealing the one end of the fluid passage; and a controller that drives the negative pressure source in a first state in which the cover member is covering the nozzle plane, wherein the controller drives the negative pressure source in a second state in which the non-nozzle plane is sealing the one end of the fluid passage.

2. The liquid discharge device as in claim 1, wherein, in the second state, the non-nozzle plane completely seals the one end of the fluid passage.

3. The liquid discharge device as in claim 2, wherein the controller cancels the second state while negative pressure is maintained in the fluid passage.

4. The liquid discharge device as in claim 2, wherein the head has the seal member, and the nozzle plane and the non-nozzle plane are formed on a predetermined plate.

5. The liquid discharge device as in claim 4, further comprising:

a carriage supporting the head, wherein the controller cancels the second state by moving the carriage while negative pressure is maintained in the fluid passage.

6. The liquid discharge device as in claim 2, wherein the non-nozzle plane comprises a first area in which a notch is formed, and a second area in which the notch is not formed, and the controller drives the negative pressure source in the second state in which the cover member makes contact with the second area of the non-nozzle plane, and then moves the seal member with respect to the cover member such that the cover member makes contact with the first area of the non-nozzle plane.

7. The liquid discharge device as in claim 1, wherein the cover member comprises a concave portion forming the one end of the fluid passage.

8. The liquid discharge device as in claim 7, wherein the cover member comprises an inner piece disposed in the concave portion, and the inner piece has a property of repelling the liquid.

9. The liquid discharge device as in claim 1, wherein, in the second state, the non-nozzle plane partially seals the one end of the fluid passage.

10. The liquid discharge device as in claim 9, wherein the cover member comprises a concave portion forming the one end of the fluid passage, and an opening that opens to a bottom surface of the concave portion, in the second state, the non-nozzle plane does not seal a predetermined portion of the one end of the fluid passage, and the predetermined portion includes a part furthest from the opening.

11. The liquid discharge device as in claim 10, wherein in a plan view of the one end of the cover member, the cover member extends along a predetermined direction, the opening is located at an area adjacent to one end of the cover member along the predetermined direction, and the predetermined portion is located at an area adjacent to the other end of the cover member along the predetermined direction.

12. The liquid discharge device as in claim 9, wherein a notch is formed in the non-nozzle plane, and in the second state, the notch causes the non-nozzle plane to not seal a part of the one end of the fluid passage.

13. The liquid discharge device as in claim 1, wherein the nozzle plane of the head is formed with a first nozzle and a second nozzle, the cover member comprises a first cover member comprising a first fluid passage, and a second cover member comprising a second fluid passage, the first cover member and the second cover member are capable of covering the nozzle plane such that one end of the first fluid passage is in communication with the first nozzle while one end of the second fluid passage is in communication with the second nozzle, the negative pressure source is connected to the first fluid passage and the second fluid passage, the non-nozzle plane of the seal member is capable of sealing the one end of the first fluid passage and the one end of the second fluid passage, the controller drives the negative pressure source in the first state in which the first cover member and the second cover member are covering the nozzle plane such that negative pressure is supplied to at least one of the first and second fluid passages, and the controller drives the negative pressure source in the second state in which the non-nozzle plane is sealing the one end of the first fluid passage and the one end of the second fluid passage such that the negative pressure is supplied to the at least one of the first and second fluid passages.

14. The liquid discharge device as in claim 13, wherein the controller cancels the second state while the negative pressure is maintained in the at least one of the first and second fluid passages.

15. The liquid discharge device as in claim 14, wherein the first nozzle and the second nozzle discharge liquids different form each other in color.

16. An ink jet printer, comprising:

the liquid discharge device as in claim 1, wherein the liquid discharge device discharges ink toward a print medium from the nozzle.

* * * * *